United States Patent [19]

Soloway

[11] Patent Number: 4,595,842

[45] Date of Patent: Jun. 17, 1986

[54] PROTECTION DEVICE FOR ELECTRONIC COMPONENTS IN VEHICLES

[76] Inventor: Norman P. Soloway, Nine Elms Farm, Amherst, N.H. 03031

[21] Appl. No.: 648,788

[22] Filed: Sep. 7, 1984

[51] Int. Cl.[4] ..... H01R 11/26

[52] U.S. Cl. ..... 307/10 R; 307/139; 339/226; 339/228; 339/239

[58] Field of Search ..... 307/10 R, 10 BP, 38, 307/139; 339/224, 226, 228, 238, 239; 200/51 R

[56] References Cited

U.S. PATENT DOCUMENTS

| | | | |
|---|---|---|---|
| 1,868,939 | 7/1932 | Conrad | 339/226 X |
| 2,706,284 | 4/1955 | Hoggatt et al. | 200/51 R X |
| 2,878,460 | 3/1959 | Coleman | 339/226 X |
| 3,529,280 | 9/1970 | Best | 339/226 R |
| 3,605,065 | 9/1971 | Shannon | 339/224 X |

*Primary Examiner*—A. D. Pellinen
*Assistant Examiner*—Derek S. Jennings
*Attorney, Agent, or Firm*—Hayes, Davis & Soloway

[57] ABSTRACT

A protection device, for electronic components of vehicles, having a vehicle battery including a battery terminal with an electrical supply clamp attached thereto, comprising an electrically conductive connector engageable with the battery terminal-clamp combination, a conductor for electrically conductive connector to the electronic components, the device permitting removal of the electrically conductive connector from the terminal-clamp combination, when desired, and an electrically insulative cover to encompass and cover all readily accessible surfaces of the electrically conductive connector and the terminal-clamp combination when the electrically conductive connector is attached thereto.

11 Claims, 4 Drawing Figures

PROTECTION DEVICE FOR ELECTRONIC COMPONENTS IN VEHICLES

This invention relates to a protection device for electronic components in vehicles, particularly, though not exclusively, for the protection of components, such as on-board computers in automobiles, which are subject to damage or destruction by surges in the electrical supply system of the automobile, for example, when a second battery is connected thereto for jump starting, etc.

As used herein "vehicle" includes automobiles, motorcycles, boats, airplanes, and other land, sea, air and space transportation means.

Electronic components of ever increasing complexity are regularly being installed in automobiles as original equipment. These components include primary components including computers and control systems which provide a number of control functions required for the vehicles operation as well as secondary components such as computers which provide information and services not basic to the operational requirements of the vehicle. Such further computers may provide information as to fuel remaining, average speed, distance to destination, current fuel flow, navigational aids, information as to non-essential functions of the automobile (for example, door lock status, ignition key status, seat belt utilization). Often these computers are sufficiently delicate for them to be damaged or destroyed by the surges which can occur in an automobiles electrical system when, for example, a second battery is connected in parallel with the automobile's battery to provide additional current for the starting of the automobile as may happen when the automobile's battery has been allowed to discharge. A typical owner's manual recommendation for preventing such damage is the suggestion that one or more fuses be removed from the fusebox of the automobile to disconnect the sensitive or delicate secondary components when such a parallel battery connection is to be made. Such a method of protecting these components is unsatisfactory as it requires knowledge which may not be readily available to those unfamiliar with the vehicle and as it must be remembered perhaps for years before such an occurrence may take place, with failure to know or remember resulting in damage and possibly destruction of these sensitive or delicate components.

The present invention provides a protection device which ensures that a battery or secondary source of electrical power cannot easily be connected in parallel with the automobile's battery without the delicate electronic secondary components being disconnected with the vehicle's power supply.

According to the invention there is provided a protection device, for electronic components of vehicles having a vehicle battery including a battery terminal and an electrical supply clamp attached thereto, comprising electrically conductive means engageable with said battery terminal-clamp combination, means for connecting said electrically conductive means to said electronic components, means for attaching said electric conductive means to said terminal-clamp combination, to provide electrically conductive engagement therewith and for permitting removal of said electrically conductive means therefrom, when desired, and electrically insulative cover means to encompass and cover all readily accessible surfaces of said electrically conductive means and said terminal-clamp combination when said conductive means is clamped.

The present invention will now be described by way of example, with reference to the accompanying drawings in which.

Figure 1:
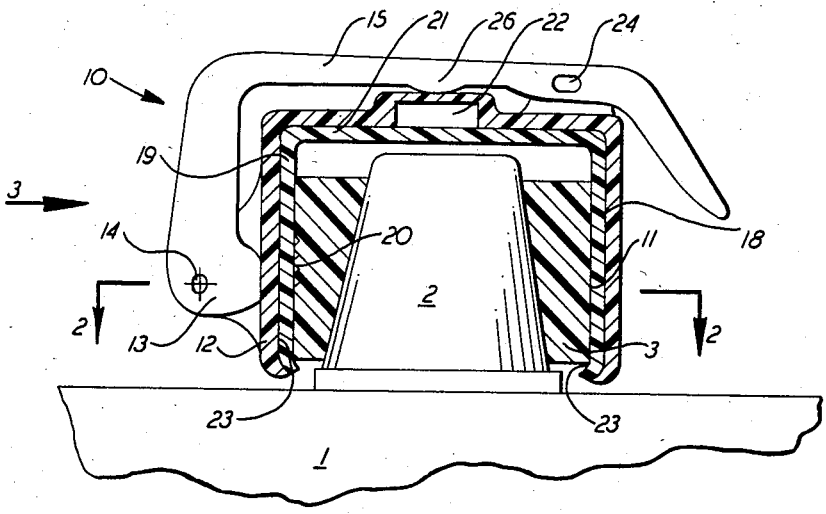
FIG. 1 is a sectional elevation through a protection device of the present invention shown attached to a battery clamp on a terminal of a vehicle battery.
Figure 2:
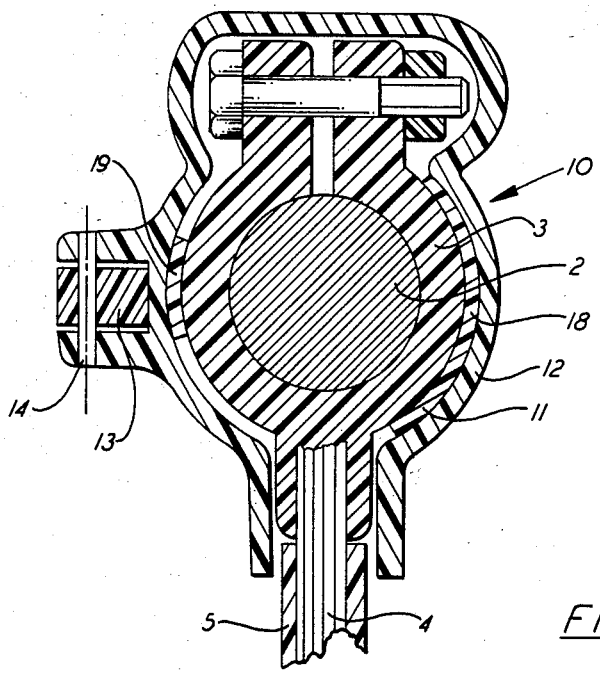
FIG. 2 is a sectional view as indicated by section line 2—2 in FIG. 1.
Figure 3:
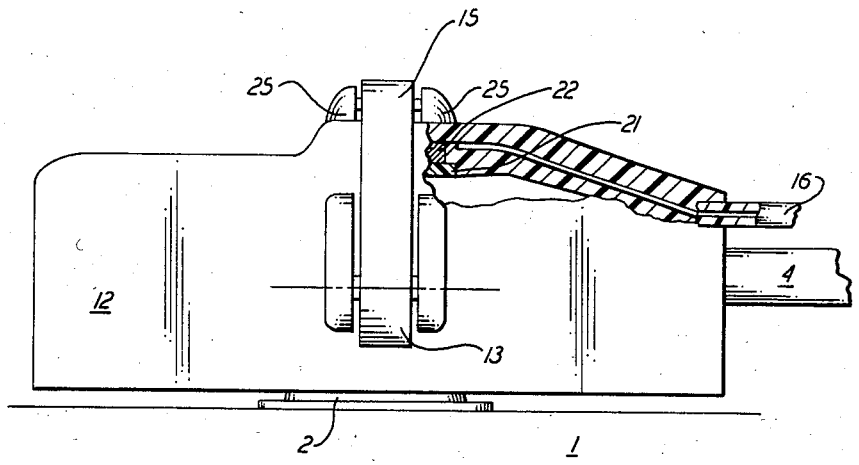
FIG. 3 is an elevation of the protection device as seen in the direction of arrow 3 in FIG. 1.

With reference to FIGS. 1, 2 and 3 a vehicle battery 1 has a terminal 2 to which a conventional electrically conductive terminal clamp 3 is attached, thereby to connect the battery 1 to electrical systems of the vehicle by way of an insulated electrical cable 4, the insulation 5 of which ends closely adjacent the clamp 3 with which the cable is in intimate electrically conductive contact. The electrical circuits supplied directly by way of the clamp 3 are designated in FIG. 4 by reference numeral 6 with the vehicle being designated by reference numeral 7. Vehicle circuits 6 include those for the supply of all electrical requirements of the vehicle essential for its operation and may include additional electrical supplies to components which are not subject to damage or destruction by surges in the electrical system of the vehicle attendant the connection of a further battery in parallel with the battery 1 of the vehicle 7.

Figure 4:
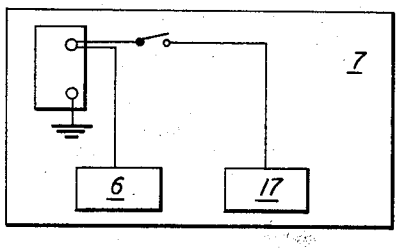
FIG. 4 is a diagrammatic representation of a vehicle having an electrical system incorporating the protection device of FIGS. 1, 2 and 3.

The protection device of the present invention is generally designated by the reference numberal 10. The protection device has an electrically conductive member encompassing a portion of the clamp 3 for electrically conductive and physical engagement therewith, an electrically insulative cover 12 which completely encompasses all readily accessible surfaces of the terminal 2, clamp 3 and member 11, overcenter cam 13 pivotally attached by means of a pin 14 to the cover 12 and integrally formed with a cam operating lever 15 and means for electrically connecting an secondary supply cable 16 to the member 11, said secondary supply cable 16 being connected, as seen in FIG. 4, to supply power to secondary components 17 which include at least those secondary components which may be damaged or destroyed by the aforementioned surges in the electrical supply system of the vehicle.

The member 11 includes a relatively rigid leg portion 18 shaped to engage one side of clamp 3, a relatively resilient leg portion 19 shaped to engage the opposite side of the clamp 3, said portion 19 having teeth or projections 20 to engage said clamp 3 to ensure good electrically conductive and mechanical contact therewith, and a bridge portion 21 extending across the top of the terminal 2 and clamp 3 to interconnect leg portions 18 and 19. The bridge portion provides connection to the secondary supply cable 16 by means which in this preferred embodiment of the invention, is a switch 22. It will be appreciated that switch 22 is optional and is not a requirement of the protective device of the present invention for its effective utilization. The ends of the leg portions remote from the bridge portion have inwardly turned lips 23 to facilitate captive engagement of the protection device 10 with the clamp 3 when clamped thereto.

The cover 12 of electrically insulating material is bonded to or molded on the member 11 and is shaped to completely electrically insulate all readily accessible surfaces of the terminal 2, clamp 3, cable 4 and member 11, when the member 11 is attached to the clamp 3. The cover 12 may be constructed of a semi-rigid material having only sufficient resilience to permit the protection device 10 to be engaged with and removed from the terminal 2 and clamp 3 combination at any temperature at which the vehicle may be expected to operate. This resilience must be sufficient to permit the overcenter cam 13 to be moved into the position shown in FIG. 1 by means of the lever 15 thereby to deform the cover 12 and member 11 to bring the relatively resilient leg portion 19 into good electrically conductive and mechanical contact with the clamp 3 with sufficient clamping action for the protection device 10 to be retained in that electrically conductive and mechanical contact with the clamp 3 when exposed to the stresses and vibrations of the operation of the vehicle. The protection device may be removed from the terminal 2 and clamp 3 combination by rotating the lever 15 in an anti-clockwise direction, as seen in FIG. 1 to operate the overcenter cam 13 to release the clamping action of that cam on the member 11 by way of the cover 12. Removal of the protection device exposes the terminal 2 and clamp 3 combination to facilitate connection of another battery in parallel with the vehicle battery 1 and at the same time disconnects from electrical supply the components 17 thereby preventing damage to these components as a result of surges which may occur upon the parallel connection of a further battery to the vehicle battery. With the protection device of the present invention, it is impossible to connect the second battery to the vehicle battery's terminal without first disconnecting the protection device and thereby components 17. As a result of this the components 17 are automatically protected from damage externally caused by surges in the electrical system of the car.

The lever 15 when the cam 13 is in its clamping position as shown in FIG. 1 is resiliently located in position by detents 24, exposed on the sides of the lever, which engage corresponding recesses in resilient extending lugs 25 disposed on either side of the lever and intrically formed with the cover 12. In addition the lever 15 carries a detent 26 which engages the switch and places it in a conductive (on) when the lever is in the closed position shown in FIG. 1. The detent 26 operates the switch through the cover 12, which at the location of the switch is sufficiently thin to have sufficient resilience for such operation. The switch 22 returns under its own resilience to a non-conductive (off) condition when the lever is rotated in a clockwise direction as seen in FIG. 1 when removal of the protection device 10 is initiated by that movement.

It will be appreciated by any man skilled in the art that a number of variations of the protection device, described with reference to the drawings of the present application, are possible without departing from the inventive concept, for example, as mentioned above, the switch 22 may be omitted in favor of a direct connection of the accessory supply cable 16 with the member 11, other clamping arrangements might be utilized to ensure reversible good electrically conductive and mechanical contact with the clamp 3, the good electrically conductive and mechanical contact with the terminal 2 and clamp 3 combination might be by a downward clamping action bring the member 11 into direct electrical contact with the terminal 2, the conventional clamp 3 might be replaced by a clamp specifically designed for use in conjunction with a protection device such as that generally illustrated by 10 or other such devices falling within the scope of the present inventive concept.

I claim:

1. A protection device, for electronic components of vehicles having a vehicle battery including a battery terminal and an electrical supply clamp attached thereto forming a battery terminal-clamp combination, comprising electrically conductive means engageable with said battery terminal-clamp combination, means for connecting said electrically conductive means to said electronic components, means for attaching said electrically conductive means to said terminal-clamp combination, to provide electrically conductive engagement therewith and for permitting removal of said electrically conductive means therefrom, when desired, and electrically insulative cover means to encompass and cover all readily accessible surfaces of said electrically conductive means and said terminal-clamp combination when said conductive means is clamped.

2. A protection device, for electronic components in vehicles having a vehicle battery with a terminal-clamp combination to provide a primary electrical supply from said battery to a primary electrical system of said vehicle; said device comprising:

electrically conductive means engageable with said terminal-clamp combination;

an electrical conductor connected to said conductive means to provide a secondary electrical supply to a secondary electrical system of said vehicle to electrically power said electronic components;

means for removably attaching said conductive means to said terminal-clamp combination in electrically conductive contact therewith; and electrically insulative cover means to encompass and cover all readily accessible electrically conductive surfaces of said conductive means and said terminal-clamp combination when said conductive means is attached thereto.

3. A device according to claim 2 wherein said attaching means comprises a resilient portion of said conductive means shaped to resiliently engage said terminal-clamp combination to provide electrically conductive and mechanical attachment thereto.

4. A device according to claim 2 wherein said attaching means is an over-center cam moveable by a lever, between a stable position in which it clamps said conductive means to said terminal-clamp combination and an open-position in which said conductive means can be placed on or removed from said terminal-clamp combination.

5. A device according to claim 4 wherein said conductive means and said insulative cover are permanently attached together.

6. A device according to claim 5 wherein said cam is pivotally attached to said insulative cover and said conductive means has a resilient portion moveable by said cam to attach said conductive means to said terminal-clamp combination.

7. A device according to claim 4 wherein said cam cooperates with a resilient portion of said conductive means to attach said device to said terminal-clamp combination.

8. A device according to claim 4 wherein a switch interconnects said conductive means and said electrical conductor, said switch being operable to a conductive state by said lever when said cam is in its stable position.

9. A vehicle having a primary electrical supply system to supply electrical power to at least electrical components of the vehicle essential to its basic operation and a secondary electrical supply system to supply electrical power to desired electrical components not required for said basic operation, said primary electrical supply being connected to a battery terminal of a battery of said vehicle by way of a terminal clamp, forming a battery terminal-clamp combination, and said secondary electrical supply being connected to said battery by a protective device comprising electrically conductive means engageable with said battery terminal-clamp combination, means for connecting said electrically conductive means to said desired electronic components, means for attaching said electrically conductive means to said terminal-clamp combination, to provide electrically conductive engagement therewith and for permitting removal of said electrically conductive means therefrom, when desired, and electrically insulative cover means to encompass and cover all readily accessible surfaces of said electrically conductive means and said terminal-clamp combination when said conductive means is clamped.

10. A vehicle battery, including a battery terminal and an electrical supply clamp attached thereto forming a battery terminal-clamp combination, in combination with a protection device for electronic components of vehicles, said protection device comprising electrically conductive means engageable with said battery terminal-clamp combination, means for connecting said electrically conductive means to said electronic components, means for attaching said electrically conductive means to said terminal-clamp combination, to provide electrically conductive engagement therewith and for permitting removal of said electrically conductive means therefrom, when desired, and electrically insulative cover means to encompass and cover all readily accessible surfaces of said electrically conductive means and said terminal-clamp combination when said conductive means is clamped.

11. A vehicle in combination with a protective device, for electronic components of vehicles, having a vehicle battery including a battery terminal and an electrical supply clamp attached thereto forming a battery terminal-clamp combination, said device comprising electrically conductive means engageable with said battery terminal-clamp combination, means for connecting said electrically conductive means to said electronic components, means for attaching said electrically conductive means to said terminal-clamp combination, to provide electrically conductive engagement therewith and for permitting removal of said electrically conductive means therefrom, when desired, and electrically insulative cover means to encompass and cover all readily accessible surfaces of said electrically conductive means and said terminal-clamp combination when said conductive means is clamped.

* * * * *